United States Patent [19]

Cavagnero et al.

[11] 4,387,585

[45] Jun. 14, 1983

[54] SPRING COILING MACHINE WITH IMPROVED COIL STARTER MEANS

[75] Inventors: Erman V. Cavagnero; Stanley M. Waligura, both of Torrington, Conn.

[73] Assignee: Torin Corporation, Torrington, Conn.

[21] Appl. No.: 224,813

[22] Filed: Jan. 13, 1981

[51] Int. Cl.[3] ..... B21F 3/04; B21F 3/10; B21F 11/00

[52] U.S. Cl. ..... 72/131; 72/132; 72/138

[58] Field of Search ..... 72/129, 131, 132, 135, 72/138, 140, 142, 143, 145

[56] References Cited

U.S. PATENT DOCUMENTS

| | | | |
|---|---|---|---|
| 2,276,579 | 3/1942 | Halvorsen et al. | 72/135 X |
| 2,925,115 | 2/1960 | Franks | 72/135 X |
| 3,402,584 | 9/1968 | Cavagnero | 72/145 X |
| 3,740,984 | 6/1973 | Bergevin | 72/138 X |

*Primary Examiner*—Ervin M. Combs
*Attorney, Agent, or Firm*—McCormick, Paulding & Huber

[57] ABSTRACT

A cyclically operable spring coiling machine includes a pair of feed rolls for intermittently advancing wire longitudinally to a coiling station. A coiling arbor and a coiling tool at the station cooperatively form leading end portions of the wire to a coil spring configuration and a cutoff tool severs the coiled leading end portions of the wire to provide individual coil springs. A diameter slide carries the coiling tool and is movable approximately along the line of wire feed movement but on a side of the coiling arbor opposite the feed rolls. A second coil starter slide mounted on the diameter slide is movable along a line of movement in a lateral direction approximately at right angles to the diameter slide movement. A coil starter motor is mounted on the machine frame and a power transmitting means including a universal joint means connects the motor with the coil starter slide to move the latter between operative wire coiling and coil starting positions. The latter position is spaced laterally from the coiling arbor to allow a short leading end portion of wire to be coiled to project beyond the arbor and be thereafter engaged by the coiling tool and bent about the arbor for a coil starting operation on lateral movement of the coil starter slide and coiling tool from its said starting position to its operative coiling position. An adjustment slide movable along a line of movement at right angles to the diameter slide and the coil starter slide is included as are back lash springs within a dove tail slide arrangement on the diameter slide.

10 Claims, 6 Drawing Figures

SPRING COILING MACHINE WITH IMPROVED COIL STARTER MEANS

BACKGROUND OF THE INVENTION

Coil starting operations, the initial bending of a leading end of wire about a coiling arbor by lateral movement of a coiling tool, have been accomplished manually and prior art spring coiling machines have also included automatic coil starting devices in the form of electric motors mounted on a diameter slide and moving a small coil slide laterally as required. Coil starter devices available in the past have not, however, been wholly satisfactory. The diameter slide which moves along a line of movement approximately corresponding to the line of wire feed movement but on a side of the coiling arbor opposite the feed rolls must be highly accurate in its operation. With a coil starter motor mounted thereon and with relatively short high speed movements of the diameter slide required in high speed operation, a considerable inertia problem results. That is, the weight of the motor combined with the weight of the slide may result in slight inaccuracies in diameter slide operation. Defective springs are of course the result of such inaccuracies.

The foregoing problem is most serious in a high speed spring coiling machine of the type disclosed in copending U.S. application Ser. No. 082,670, Erman V. Cavagnero and Nicholas J. Marracino, Spring Coiling Machine With Improved Feed Roll Drive Means filed Oct. 9, 1979, now abandoned. Accordingly, the improved coil starter means of the present invention is particularly well suited to such a high speed coiler but is also of general utility with other spring coiling machines.

It is the general object of the present invention to provide a spring coiling machine having an improved coil starter device which exhibits a high degree of accuracy and dependability in use particularly in high speed operation and which yet minimizes inertia problems associated with diameter slide movement.

SUMMARY OF THE INVENTION

In fulfillment of the foregoing object, a cyclically operable spring coiling machine having a frame and a coiling station is provided with at least one pair of oppositely rotatable feed rolls on the frame for intermittently advancing wire longitudinally to the coiling station. A relatively fixed coiling arbor at the coiling station is offset slightly with respect to the line of wire feed movement so that the wire is advanced long one side of the arbor. At least one coiling tool is provided at the coiling station and is arranged to engage the longitudinally advancing wire to obstruct the linear movement thereof and to thereby progressively bend the same about the coiling arbor and impart a coiling stress thereto resulting in the formation of coil springs. A cutoff tool at the coiling station is operable successively to sever coiled leading end portions of the wire whereby to provide individual coil springs.

As is conventional, a diameter slide carries the coiling tool and is movable longitudinally toward and away from the coiling arbor generally along the line of wire feeding movement but on the side of the arbor opposite the feed rolls. Further, conventional means may be employed in operating the diameter slide for example in the formation of tapered springs where diameter changes progressively as the spring is coiled about the coiling arbor. The diameter slide also carries at a front portion thereof a coil starter slide which is mounted on the diameter slide and resides adjacent the coiling arbor. The coil starter slide is movable in one and an opposite direction laterally along a line of movement approximately at right angles to the diameter slide movement and wire feed movement. The coiling tool is carried on the coil starter slide.

In accordance with the present invention, a coil starter motor is mounted on the machine frame at a location somewhat remote from the diameter slide and a power transmitting means including a universal joint means is provided for connecting the coil starter motor with the coil starter slide. The coil starter slide is operable by the motor through the power transmitting means to move between operative wire coiling and coil starting positions. The coil starting position is spaced laterally from the coiling arbor a slight distance to allow a short leading end portion of wire to be coiled to project beyond the coiling arbor. When the coil starter motor subsequently operates to move the coiling tool laterally to its operative coiling position the short projecting end portion of the wire is engaged by the coiling tool and is bent about the arbor in a coil starting operation. Coiling proceeds thereafter in a conventional manner.

As a result of the removal of motor weight from the diameter slide, with the coiler starter motor being mounted on the machine frame at a remote location, the inertia problems encountered with the slide are substantially eliminated. Short quick movements of the slide in high speed operation can be accomplished with a high degree of accuracy. Further, the slide is provided with at least one, and preferably a pair of, heavy back lash springs and precise operation is enhanced in very slight movements of the diameter slide as in the formation of compression springs where there is an initial change of pitch at the begining of spring formation, such pitch change being accompanied by a slight change in diameter in order to prevent an undesired taper.

DESCRIPTION OF PREFERRED EMBODIMENT

Figure 1:
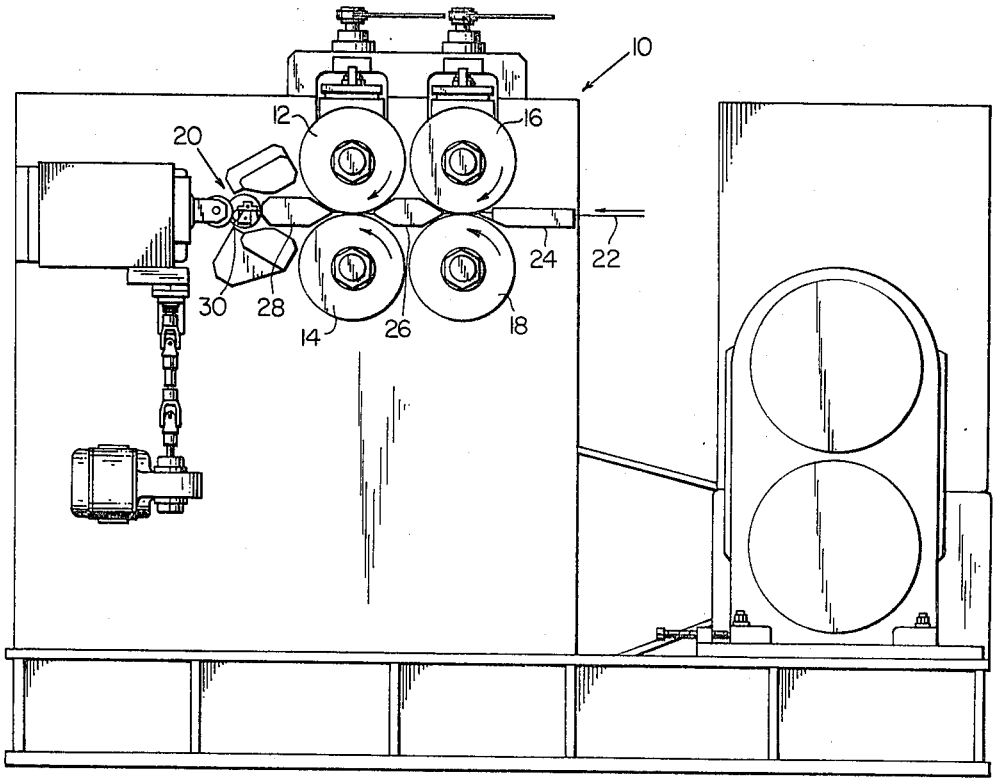
FIG. 1 is a somewhat schematic illustration of a spring coiling machine viewed from the front and including the improved coil starter means of the present invention.
Figure 2:
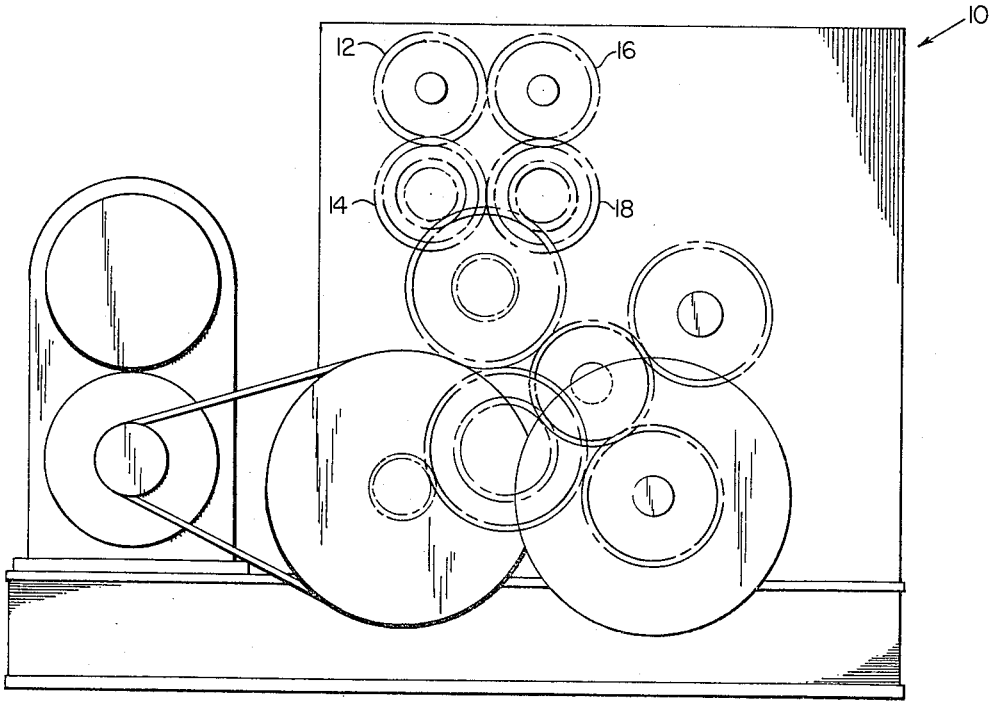
FIG. 2 is an enlarged and somewhat schematic view taken from the rear of the machine and illustrating various drive means in the machine associated with the operating means of FIG. 1.
Figure 3:
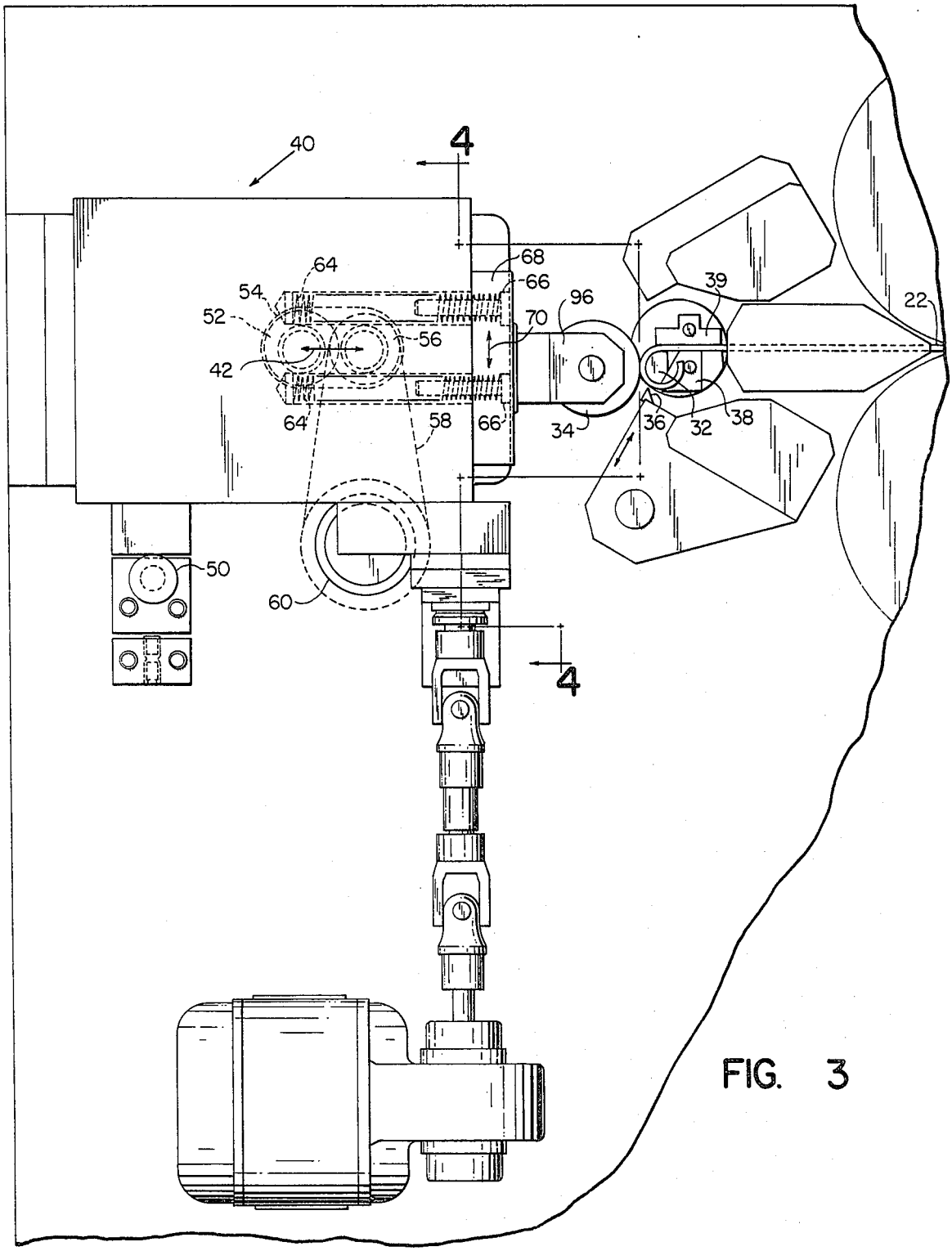
FIG. 3 is a further enlarged and somewhat schematic view similar to FIG. 1 but showing only a fragmentary portion of the machine and better illustrating the improved coil starter means of the present invention.

Referring particularly to FIG. 1, it will be observed that a spring coiling machine indicated generally at 10 has a main drive means indicated generally at 11 and including electric motor-reducer 13 which operates first and second pairs of oppositely rotatable feed rolls 12,14 and 16,18 for advancing wire longitudinally leftwardly to a coiling station indicated generally at 20. In FIG. 1, the upper feed rolls 12,16 rotate in a clockwise direction and the lower feed rolls 14,18 rotate in a counterclockwise direction to feed wire 22 leftwardly through guides 24,26 and 28 for the formation of the wire into a coil spring configuration 30 at its leading end portion. As best illustrated in FIG. 3, the leading end portion of the wire 22 is coiled about a coiling arbor 32 at the coiling station 20, the arbor cooperating with a coiling tool 34 in the form of a coiling roll. Coiling arbor 32 and tool 34 are relatively fixed at the coiling station so that longitudinally advancing wire engages the roll 34 and is obstructed in its linear movement thereby, the wire thus being progressively bent about the arbor 32 with a coiling stress imparted thereto resulting in the formation of the leading end coil spring configuration.

When the leading end portion of the wire 22 has been bent to a coil spring configuration 30 about the arbor 32 it is severed from the remaining portion of the wire 22 by means of a cutoff tool indicated at 36, individual coil springs thus being formed. Element 38 at the coiling station 20 may take the form of a pitch tool engageable with the wire during coiling about the arbor 32 progressively to pitch the same as required for the coil spring to be formed. Element 39 is a final wire guide which cooperates with an upper surface of the pitch tool in guiding the wire 22 immediately prior to coiling of the wire.

As thus far described and illustrated schematically, the spring coiling machine 10 is or may be conventional and for further illustration and description of such a machine including operating means for elements such as cutoff tool 36 and pitch tool 38, reference may be had to Bergevin and Nigro U.S. Pat. No. 2,119,002 for Spring Coiling Machine, dated May 3, 1938 and Bergevin U.S. Pat. No. Re. 24,345 for Spring Coiling Machine dated Aug. 20, 1957. The machines shown and described in these patents, however, are of the segment drive type and while highly accurate and dependable in opperation they are limited as to the rate of spring production achievable thereon. The spring coiling machine shown and described in the aforementioned Cavagnero and Marracino application is adapted for high speed production but is also highly accurate and dependable in operation. As mentioned, the improved coil starter means of the present invention finds utility on either type of machine but is particularly well suited to the high speed machine of the copending application.

Figure 4:
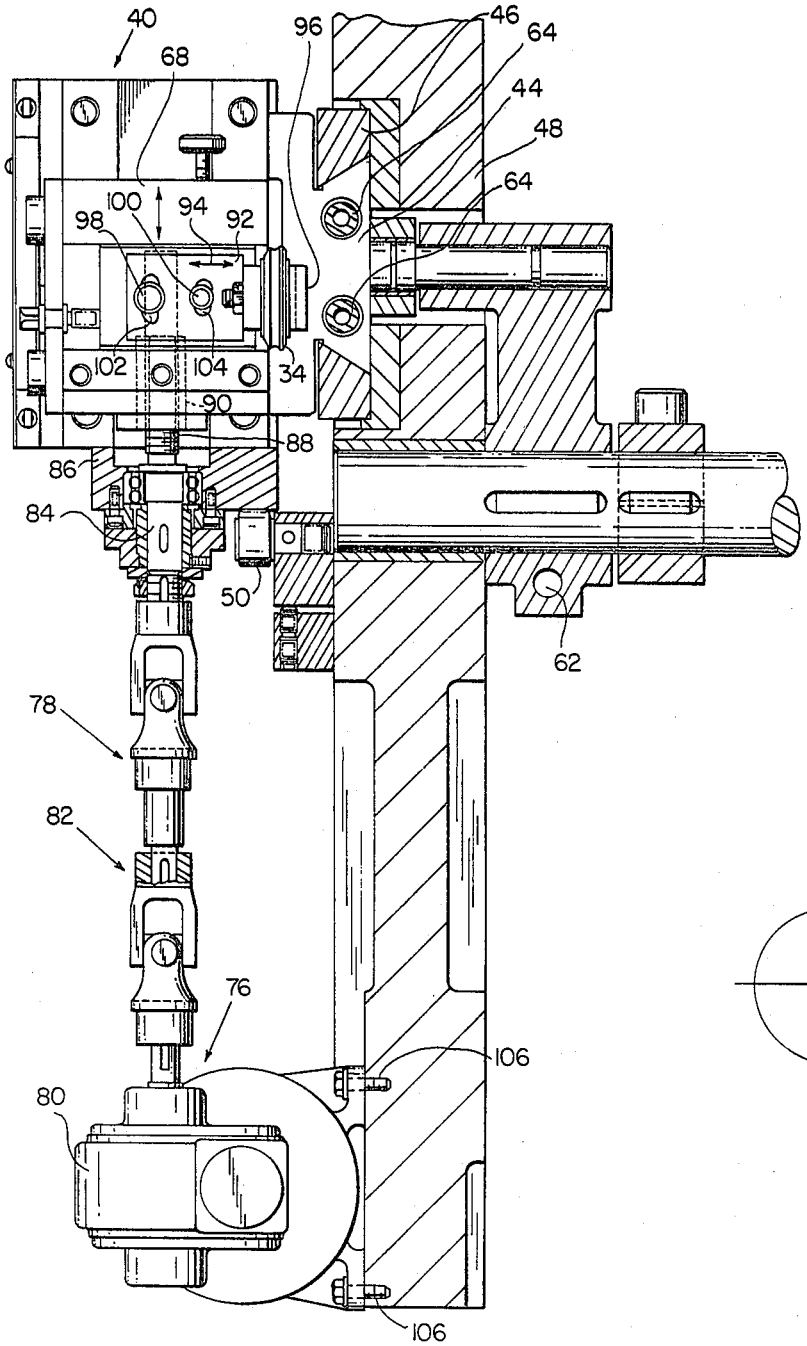
FIG. 4 is a vertical section taken generally as indicated at 4,4 in FIG. 3 and showing the improved coil starter means of the present invention.

Referring particularly to FIGS. 3 and 4, a diameter slide indicated generally at 40 carries the coiling roll 34 and is movable generally as indicated by arrow 42 along a line of movement approximating the line of wire feed but on the side of the arbor 32 opposite the wire feed rolls. A dove tail slide member 44, FIG. 4, is slidably received in a guide way 46 on the machine frame 48 and support rolls, 50,50 may also be provided for the slide 40. A pin 52, FIG. 3, attached to the slide 40 has an associated link 54 pivotally connected at an opposite end portion to a pin 56 carried on an oscillable arm 58 in turn keyed to a shaft 60. A drive mechanism for the diameter slide 40 may be conventional in form and may comprise a cam and associated drive elements including a push rod connected with the arm 60 at 62, FIG. 4. Reference may be had to the aforementioned U.S. patents for details of the operating mechanism for the slide 40. It is sufficient here to point out that such operating mechanism moves the slide 40 along the line of movement 42 as may be required in the diameter control of springs formed by the coiling roll 34 about the arbor. That is, if a constant diameter spring is required the slide 40 may be operated to maintain a fixed position of the coiling roll 34. A tapered spring, on the other hand, may require a progressive movement of the slide and coiling roll during formation of the spring. Still further, even when a constant diameter spring is to be coiled, and when there may be a slight pitch change at the beginning and/or the end of spring formation, it may be necessary to simmultaneously effect a slight diameter change in the position of the coiling roll in order to avoid a change in diameter of the spring. The operating mechanism, diameter slide and coiling roll are moved accordingly for such an operation.

As will be apparent in FIG. 3, a pair of heavy back lash springs 64,64 are provided with head portions 66,66 held in fixed position to urge the dove tail member 44 leftwardly in FIG. 3. That is, the springs 64 are disposed within the dove tail member as best illustrated in FIG. 4. The operating mechanism including the pin 52, link 54 arm 58 etc. urge the slide 40 in the opposite direction or rightwardly in FIG. 3. The provision of the heavy back lash springs 58,58 is of particular significance in the very slight but accurate movements of the coiling tool required for diameter correction with a compression spring as mentioned above. That is, the slide and spring arrangement as described provides for a precise correction and for precise coiling roll movements as may be required in other operations in the arrangement shown and under conditions of high speed operation of the machine.

The diameter slide 40 also carries a coil starter slide 68 as best illustrated in FIGS. 3 and 4. The coil starter slide 68 is movable along a line of movement as indicated generally by arrow 70 in FIGS. 3 and 4 and in a lateral direction; that is, the slide is movable generally at right angles to the line of wire feed movement and the line of movement of the diameter slide 40. As shown, coil starter slide 68 moves vertically at a front end portion of the diameter slide 40 and supports the coiling roll 34.

Figure 5:
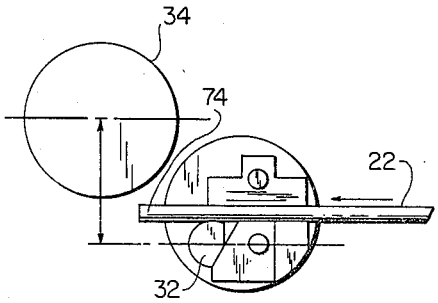
FIG. 5 is a fragmentary schematic view showing a coiling arbor, a coiling tool in a coil starting position and a front end portion of advanced wire to be coiled.
Figure 6:
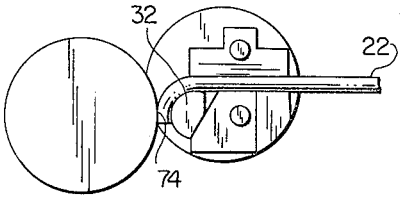
FIG. 6 is a schematic view similar to FIG. 5 but showing the coiling tool in its operative coiling position, the front end portion of the advanced wire having been bent downwardly about the coiling arbor in a coil starting operation.

Vertical movement of the coil starter slide 68 is effected between coil starting and operative coiling positions as best illustrated in FIGS. 5 and 6. In FIG. 5 a coil starting position of the coiling roll 34 is illustrated and it will be apparent that the coiling roll is slightly elevated so that a leading end portion 74 of wire 22 can project atop the arbor 32 and beneath the coiling roll. When the coiling roll 34 is subsequently lowered to its operative coiling position shown in FIG. 6 the leading end portion 74 of the wire 22 is bent downwardly about the arbor 32 as illustrated for an efficient start of the coiling operation. Further leftward advancement of the wire 22 will of course result in coiling of the spring about the arbor 32 as illustrated in FIG. 3.

The means for elevating and lowering the coiling roll 34, in addition to the coil starter slide 68 includes a coil starter motor indicated generally at 76 and a power transmitting means indicated generally at 78. The motor 76 is reversible and is preferably of the electric rotary type and has an associated speed reducer 80 driving the power transmitting means 78, the latter including a universal joint means 82 which extends upwardly to an output shaft 84, FIG. 4. The output shaft 84 is journaled within a block 86 secured at a lower portion of the slide 40 and has an externally threaded member 88 projecting upwardly therefrom. The member 88 drivingly engages an internally threaded member 90 carried by the coil starter slide 68. Thus, on operation of the motor 76, the speed reducer 80, and the power transmitting means 78, the slide 68 may be moved upwardly and downwardly as required for movement of the coiling roll 34 between its coil starting position of FIG. 5 and its operative coiling position of FIG. 6.

The coil starter slide 68 preferably also carries a small adjustment slide 92 which is mounted thereon in a guide way therebehind and which may be moved leftwardly and rightwardly in FIG. 4. More particularly, the adjustment slide 92 is movable generally as indicated by the small arrow 94 along a line of movement which is perpendicular to the line of movement of the slide 40 and also perpendicular to the line of movement of the slide 68. Thus, the coiling roll 34 carried by the adjustment slide 92 on the bracket 96 may be adjusted precisely as required for alignment with a leading end portion of wire 22 fed leftwardly in the machine by the aforementioned feed rolls.

Still further, it will be observed that the adjustment slide 92 includes a pair of binder screws 98,100 associated respectively with arcuate slots 102,104. The arcuate slots 102,104 provide for a slight arcuate or angular adjustment of the slide 92 for precise alignment of the coiling roll 34 with wire which is urged thereagainst by the feed rolls.

As will be apparent from the foregoing, the coil starter device of the present invention serves to minimize inertia associated with the diameter slide 40. That is, the coil starter motor 76 is secured to the frame of the machine 48 as by means of suitable screws 106,106 and is fully supported by the frame as is the speed reducer 80. Thus, there is no motor weight to be carried by the slide 40 and the slide may be designed for minimal weight and inertia. With the inclusion of the heavy back lash springs 64,64 highly accurate positioning of the coiling tool 34 can be accomplished in very slight and rapid movement of the slide 40 during high speed machine operation. Further, the coil starting operation of the coiling roll 34 is highly efficient with more than adequate motive force provided to the coiling roll during its downward movement and yet without the provision of a motor and its accompanying inertia on the diameter slide 40.

We claim:

1. In a cyclically operable spring coiling machine having a frame and coiling station; the combination of at least one pair of oppositely rotatable feed rolls on said frame for intermittently advancing wire longitudinally to the coiling station, a main drive means for said feed rolls, a relatively fixed coiling arbor at the coiling station, at least one coiling tool at the coiling station arranged to engage the longitudinally advancing wire to obstruct the linear movement thereof whereby progressively to bend the same about the coiling arbor and impart a coiling stress thereto resulting in the formation of a coil spring configuration at a leading end portion thereof, a cut-off tool at said coiling station operable by said main drive means successively to sever coiled leading end portions of the wire whereby to provide individual coil springs, a diameter slide movable by said main drive means longitudinally toward and away from said coiling arbor generally along the line of wire feeding movement but on the side of said arbor opposite said feed rolls, a coil starter slide mounted on said diameter slide adjacent said coiling arbor and movable in one and an opposite direction laterally along a line of movement approximately at right angles to the diameter slide movement and wire feed movement, said coil starter slide carrying said coiling tool, a small coil starter motor independent of said main drive means mounted on the machine frame, and power transmitting means including universal joint means connected between said coil starter motor and said coil starter slide and operable by said motor to move said coil starter slide and coiling tool between operative wire coiling and coil starting positions, said latter position being spaced laterally from said coiling arbor to allow a short leading end portion of wire to be coiled to project beyond the arbor and to be thereafter engaged by the coiling tool and bent about the arbor for a coil starting operation on lateral movement of the coil starter slide and coiling tool from said starting position to said operative coiling position.

2. The combination in a cyclically operable spring coiling machine as set forth in claim 1 wherein said coil starter slide and power transmitting means include motion converting means for effecting linear slide movement in response to rotary movement of said power transmitting means derived from said coil starter motor.

3. The combination in a cyclically operable spring coiling machine as set forth in claim 2 wherein said motion converting means take the form of interengaging threaded members respectively associated with said coil starter slide and said power transmitting means.

4. The combination in a cyclically operable spring coiling machine as set forth in claim 1 wherein said coil starter motor is of the electrical type with a rotary output member, and wherein said power transmitting means includes a speed reducer associated with said motor and interposed between said motor and said universal joint means.

5. The combination in a cyclically operable spring coiling machine as set forth in claim 1 wherein said coiling tool takes the form of a freely rotatable coiling roller adapted to engage and obstruct advancing wire and to coil the same as aforesaid.

6. The combination in a cyclically operable spring coiling machine as set forth in claim 1 wherein said coil starter slide carries a small adjustment slide adapted for movement along a line of movement substantially perpendicular to the line of movement of the coil starter slide and the line of movement of the diameter slide, the adjustment slide carrying the coiling tool and serving to position the same precisely adjacent the arbor for efficient coiling of the advancing wire.

7. The combination in a cyclically operable spring coiling machine as set forth in claim 6 wherein said adjustment slide is adapted for angular adjustment in one and an opposite direction from its aforesaid line of movement.

8. The combination in a cyclically operable spring coiling machine as set forth in claim 1 wherein said diameter slide includes an operating means for urging the same in one direction along its line of movement and at least one back lash spring for urging the diameter slide in an opposite direction.

9. The combination in a cyclically operable spring coiling machine as set forth in claim 8 wherein said diameter slide has a dove tail slide member and a dove tail guideway associated therewith, and wherein a pair of back lash springs are provided and are mounted within the dove tail slide member of the diameter slide for urging the same in opposition to the slide operating means.

10. The combination in a cyclically operable spring coiling machine as set forth in claim 9 wherein said diameter slide operating means urges the slide toward the coiling arbor and wherein said back lash springs urge the slide away from the arbor.

* * * * *